US006595384B2

(12) United States Patent
Takahashi

(10) Patent No.: US 6,595,384 B2
(45) Date of Patent: Jul. 22, 2003

(54) SOLID DRUG PRODUCT SUPPLYING DEVICE

(75) Inventor: Hideyuki Takahashi, Ota (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/866,426

(22) Filed: May 24, 2001

(65) Prior Publication Data

US 2001/0048001 A1 Dec. 6, 2001

(30) Foreign Application Priority Data

May 31, 2000 (JP) ..... 2000-163835

(51) Int. Cl.[7] ..... G07F 11/00
(52) U.S. Cl. ..... 221/7; 221/312 R
(58) Field of Search ..... 221/7, 13, 9, 131, 221/119, 303, 311, 312 R; 222/108

(56) References Cited

U.S. PATENT DOCUMENTS 4,562,941 A * 1/1986 Sanfilippo ..... 222/108
6,216,910 B1 * 4/2001 Numerick ..... 221/7

FOREIGN PATENT DOCUMENTS

GB 2241696 * 11/1991
JP 2000-098372 4/2000

* cited by examiner

*Primary Examiner*—Kenneth W. Noland
(74) *Attorney, Agent, or Firm*—Darby & Darby

(57) ABSTRACT

A solid drug product supplying apparatus including a first partition plate 27 which is slidably secured to the chute 6 and has a first fitting portion 27A, and a second partition plate 28 is slidably secured to the chute 6 and has a second fitting portion 28A fitted to the first fitting portion 27A when the first partition plate 27 is slid by a predetermined amount and an opening portion 28B through which the solid drug products are passed.

8 Claims, 11 Drawing Sheets

SOLID DRUG PRODUCT SUPPLYING DEVICE

BACKGROUND OF THE INVENTION

1. Field of the Invention

The present invention relates to a solid drug product supplying apparatus for filling solid drug products indicated by a medical prescription in a hospital, a drug store, etc. (hereinafter the solid drug products contain all the solidified drug products such as tablets, capsules, pills, troches, etc.).

2. Description of the Related Art

A solid drug product supplying apparatus which prepares prescribed kinds of tablets to fill prescribed tablets into a container such as a bottle or the like every kind has been known. The applicant of this application has proposed such a solid drug product supplying apparatus in Japanese Laid-open Patent Application No. 2000-98372.

Here, a solid drug product supplying apparatus will be described with reference to FIGS. 1 to 5.

First, the solid drug product supplying apparatus will be briefly described with reference to FIGS. 1 and 2.

FIG. 1 is a front view showing the solid drug product supplying apparatus, and FIG. 2 is a perspective view showing the solid drug product supplying apparatus.

The solid drug product supplying apparatus 1 stocks plural kinds of a large number of solid drug products therein, and supplies an indicated kind and number of solid drug products to a chute 6 at the lower portion thereof.

A partition plate 26 is slidably secured to the chute 6. Accordingly, the solid drug products supplied to the chute 6 are dammed by the partition plate 26 and temporarily trapped there.

Thereafter, a pharmacist or the like puts the mouth of a bottle to the outlet of the chute 6 and then slides the partition plate 26 to make the solid drug products thus trapped flow into the bottle.

The chute 6 is disposed on a recess portion 1*a* of the solid drug product supplying apparatus 1 to prevent the chute 6 from projecting excessively outwardly from the main body of the solid drug product supplying apparatus 1.

Next, the chute 6 will be described with reference to FIGS. 3 to 5.

FIG. 3 is a diagram showing a substantially cylindrical chute, and FIG. 4 is a diagram showing the partition plate 26. FIG. 5 is a diagram showing the chute 6 to which the partition plate 26 is secured.

The chute 6 is formed of a transparent hard synthetic resin, and is designed in a cylindrical form having a polygonal shape in section. The chute 6 is also designed to extend in an obliquely forward and downward direction.

As shown in FIG. 5, the partition plate 26 is freely detachably and slidably disposed at the front side of the outlet 6A at the lower end of the chute 6 (viewed from FIG. 5), and the outlet 6A is freely opened/closed by the partition plate 26. The partition plate 26 is inserted into a slit 6D formed at the front side of the chute 6 as shown in FIG. 3.

A magnet 26A is secured to the partition plate 26, and a sensor (not shown) comprising a magnetic switch is secured onto the lower surface of the chute 6 to detect the opening/closing state of the partition plate 26. By detecting the opening/closing state of the partition plate 26, after some solid drug products are supplied to the chute 6, next some solid drug products are prohibited from being supplied to the chute 6. In this case, when the partition plate 26 is once opened and then closed, the next solid drug products are allowed to be supplied to the chute 6. Accordingly, there can be avoided such a disadvantage that solid drug products are prevented from falling into the chute 6 under the state that other solid drug products are trapped in the chute 6.

The chute 6 is designed to be somewhat large in size in order to increase the content amount, and the lower surface at the tip thereof is tapered from both the sides thereof to have slant faces 6C. Therefore, even when the mouth of a bottle to be filled with solid drug products is small, the solid drug products can be filled into the bottle so that no drug product drops.

If the tip of the chute 6 is excessively tapered, the outlet of the chute 6 may be clogged with the solid drug products with higher probability. On the other hand, if the tip of the chute 6 is excessively large in size, the solid drug products may drop with higher probability when they are filled into a bottle having a small mouth.

The solid drug product supplying apparatus supports plural kinds of solid drug products, and those solid drug products are frequently different in shape, size and weight every kind. Therefore, it is difficult to design the tapered shaped of the chute 6 so that the filling of solid drug products is excellently performed at all times.

SUMMARY OF THE INVENTION

Therefore, an object of the present invention is to provide a solid drug product supplying apparatus which can prevent a chute from being clogged with solid drug products and easily carried out filling of solid drug products into a bottle having a small mouth.

In order to attain the above object, according to the present invention, a solid drug product supplying apparatus for supplying solid drug products to a container, is characterized by including: a chute for passing the solid drug products therethrough to the container; and a partition unit that is slidably secured to the chute to temporarily trap the solid drug products and allows passage of the solid drug products while the amount of the solid drug products passed is varied in accordance with the sliding amount of the partition unit.

In the solid drug product supplying apparatus, the partition unit has an opening portion through which the solid drug products are passed, and the opening portion of the partition unit is varied in area in accordance with the sliding amount of said partition unit.

In the solid drug product supplying apparatus, the opening portion of the partition unit is increased in area in accordance with the sliding amount of said partition unit.

In the solid drug product supplying apparatus, the opening portion of the partition unit is stepwise or gradually increased in area in accordance with the sliding amount of the partition unit.

In the solid drug product supplying apparatus, the partition unit has an opening portion through which the solid drug products are passed, and the lateral width of the opening portion of the partition unit is increased in accordance with the sliding amount of the partition unit.

In the solid drug product supplying apparatus, both the wall of the partition unit and the inner wall of the chute define an opening portion through which the solid drug products are passed, and the opening portion is varied in area in accordance with the sliding amount of the partition unit.

In the solid drug product supplying apparatus, the partition unit has a first partition plate having a first fitting portion, and a second partition plate having a second fitting portion which is fitted to the first fitting portion and slid interlockingly with the first partition plate when the first partition plate is slid by a predetermined sliding amount, and an opening through which the solid drug products are allowed.

In the solid drug product supplying apparatus, the opening is a notch extending upwardly from the lowermost end of the second partition plate.

In the solid drug product supplying apparatus, the solid drug product supplying apparatus supplies an indicated kind of solid drug products in plural kinds of solid drug products to the chute.

DETAILED DESCRIPTION OF THE PREFERRED EMBODIMENTS

Preferred embodiments according to the present invention will be described hereunder with reference to the accompanying drawings.

First, a solid drug product supplying apparatus according to a first embodiment of the present invention will be described with reference to FIGS. 1, 2 and 6 to 8.

Figure 1:
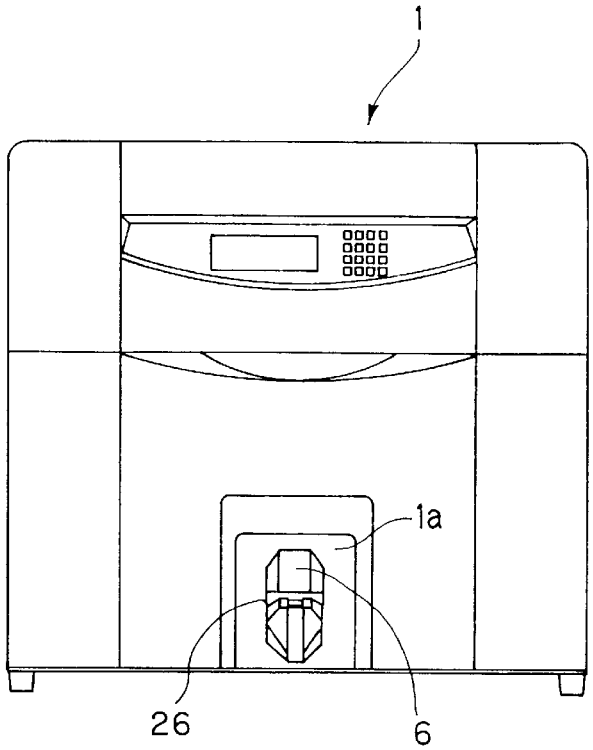
FIG. 1 is a front view showing a solid drug product supplying apparatus.
Figure 2:
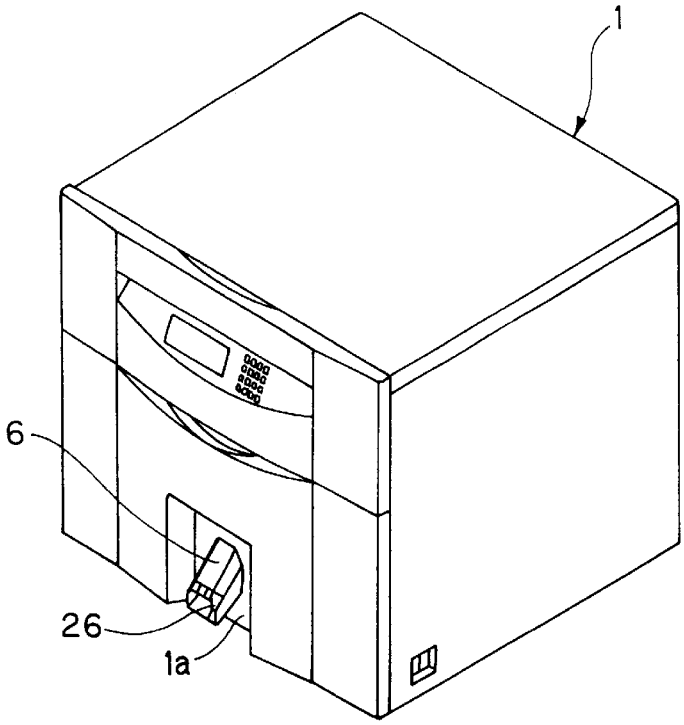
FIG. 2 is a perspective view showing the solid drug product supplying apparatus.
Figure 3:
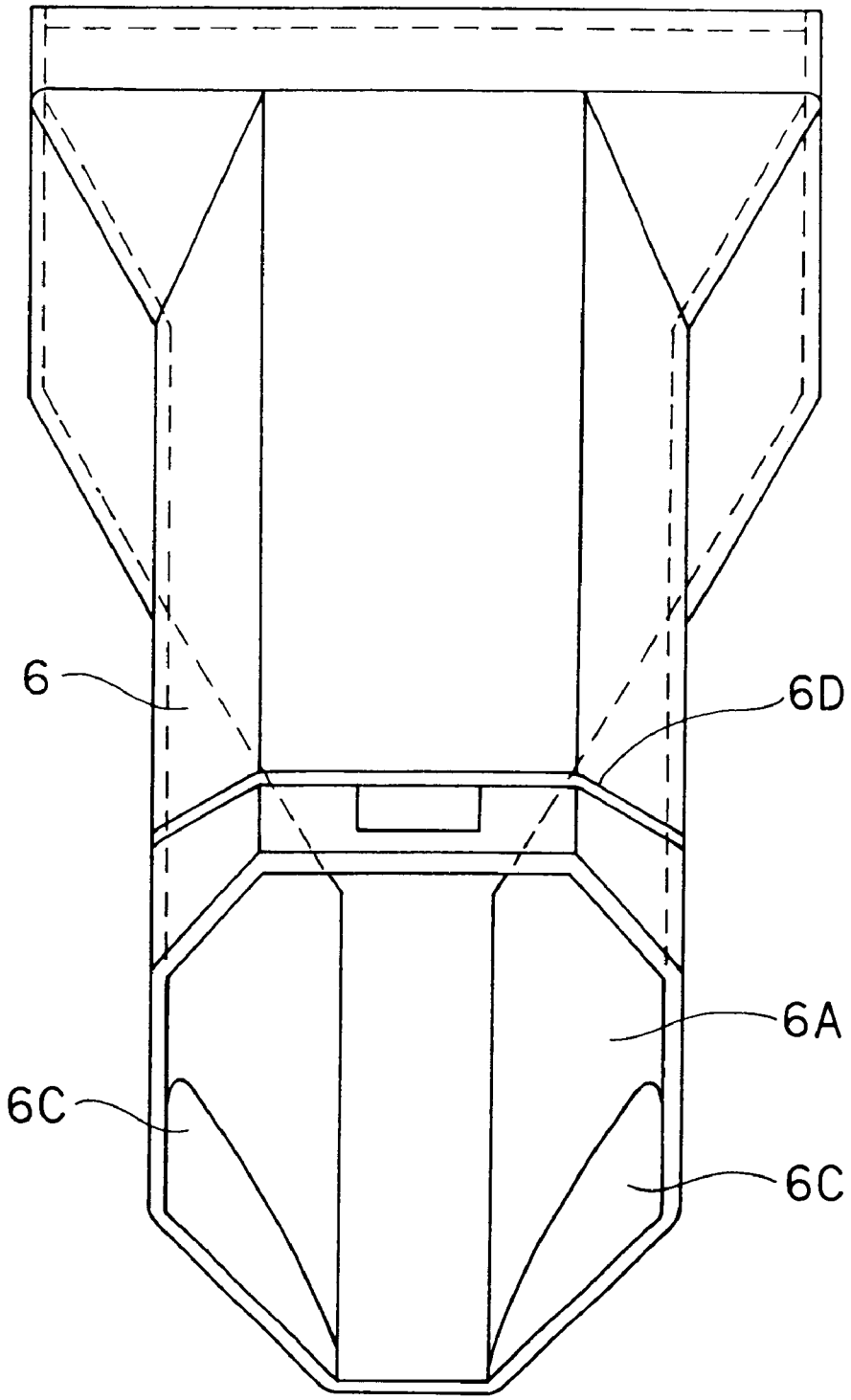
FIG. 3 is a front view of a chute of a solid drug product supplying apparatus of an application pertaining to this application.
Figure 4:
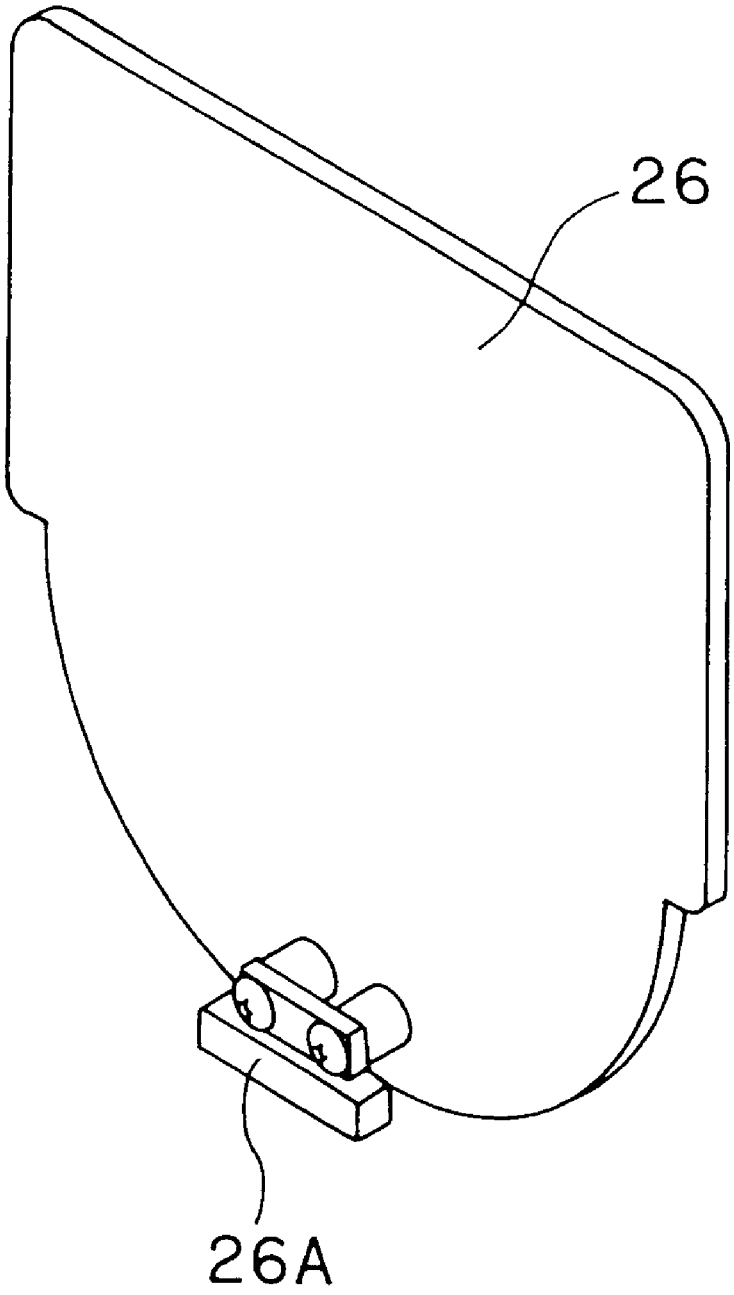
FIG. 4 is a diagram showing a partition plate of the solid drug product supplying apparatus of the pertaining application.
Figure 5:
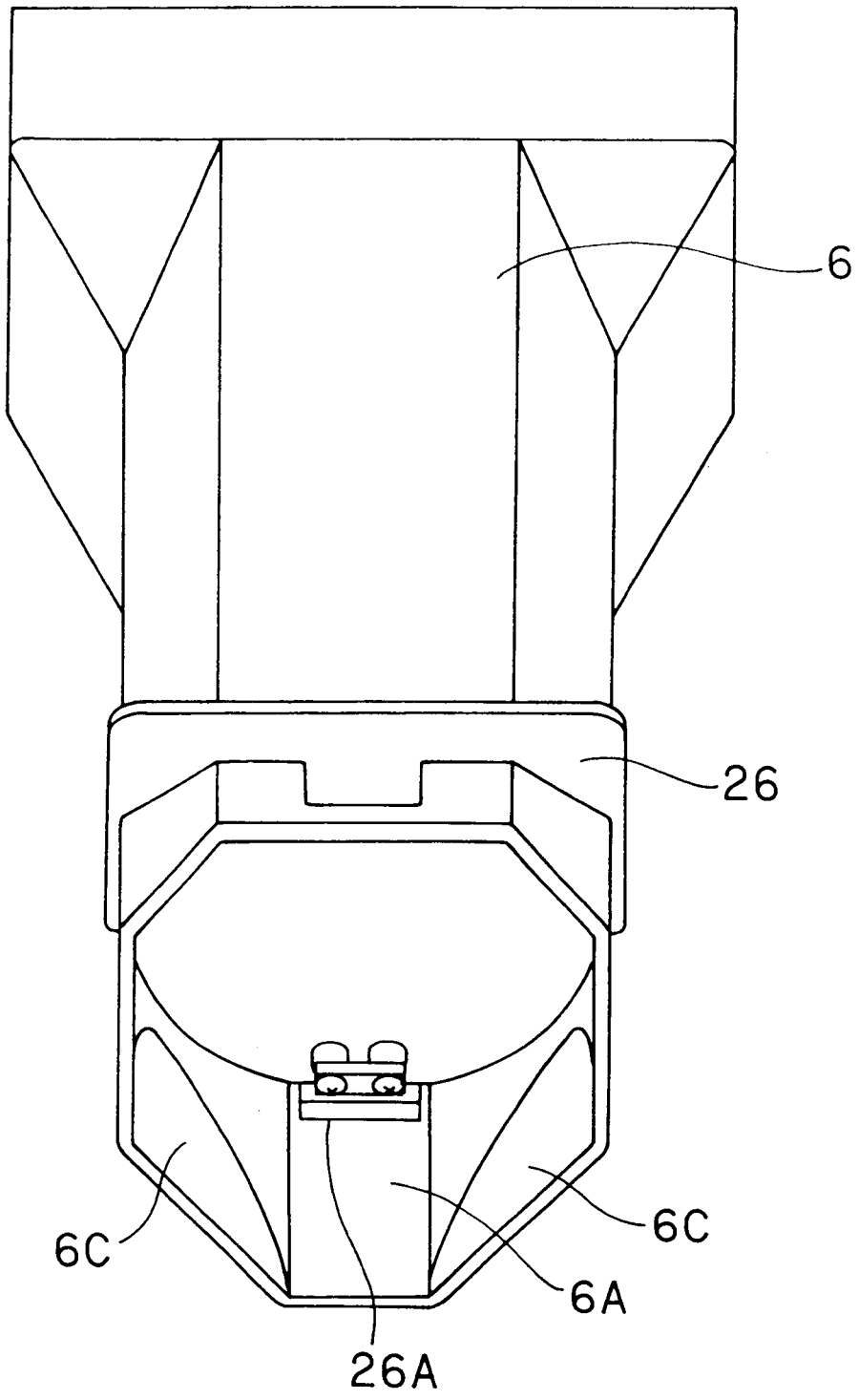
FIG. 5 is a front view showing a chute of the solid drug product supplying apparatus of the pertaining application.

The basic solid drug product supplying apparatus of this embodiment is substantially the same as that of FIGS. 1 and 2, except of the chute. Therefore, the construction of the chute 6 of the solid drug product supplying apparatus of this embodiment will be described with reference to FIGS. 6 to 8.

Figure 6:
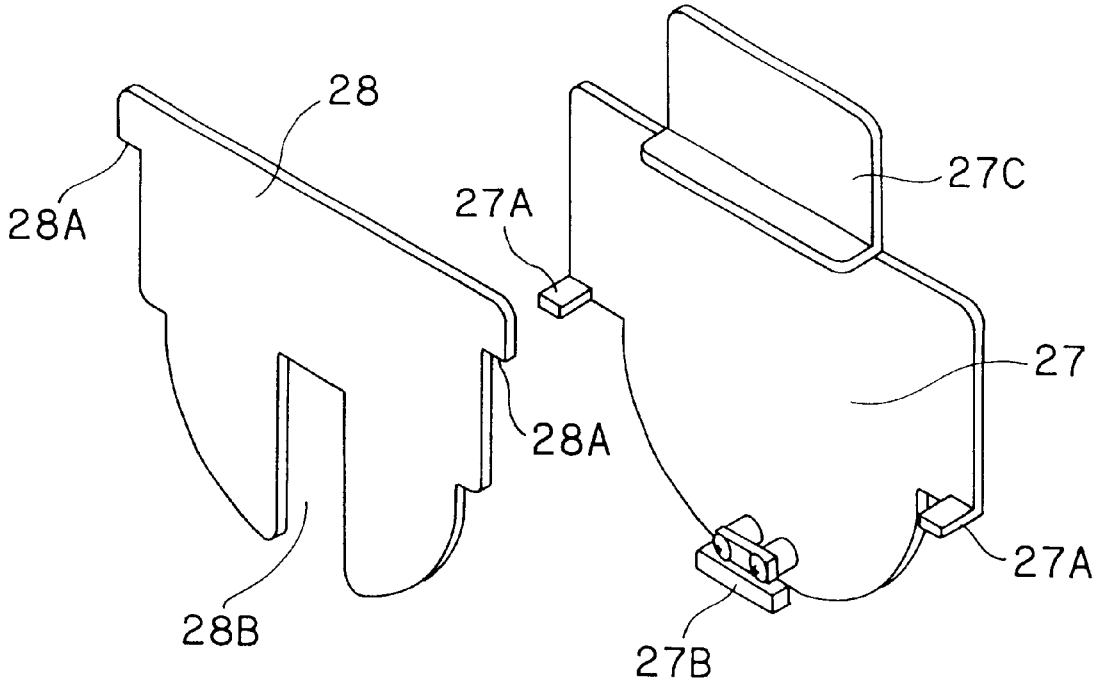
FIG. 6 is a diagram showing a partition plate of a solid drug product supplying apparatus according to a first aspect of the present invention.
Figure 7:
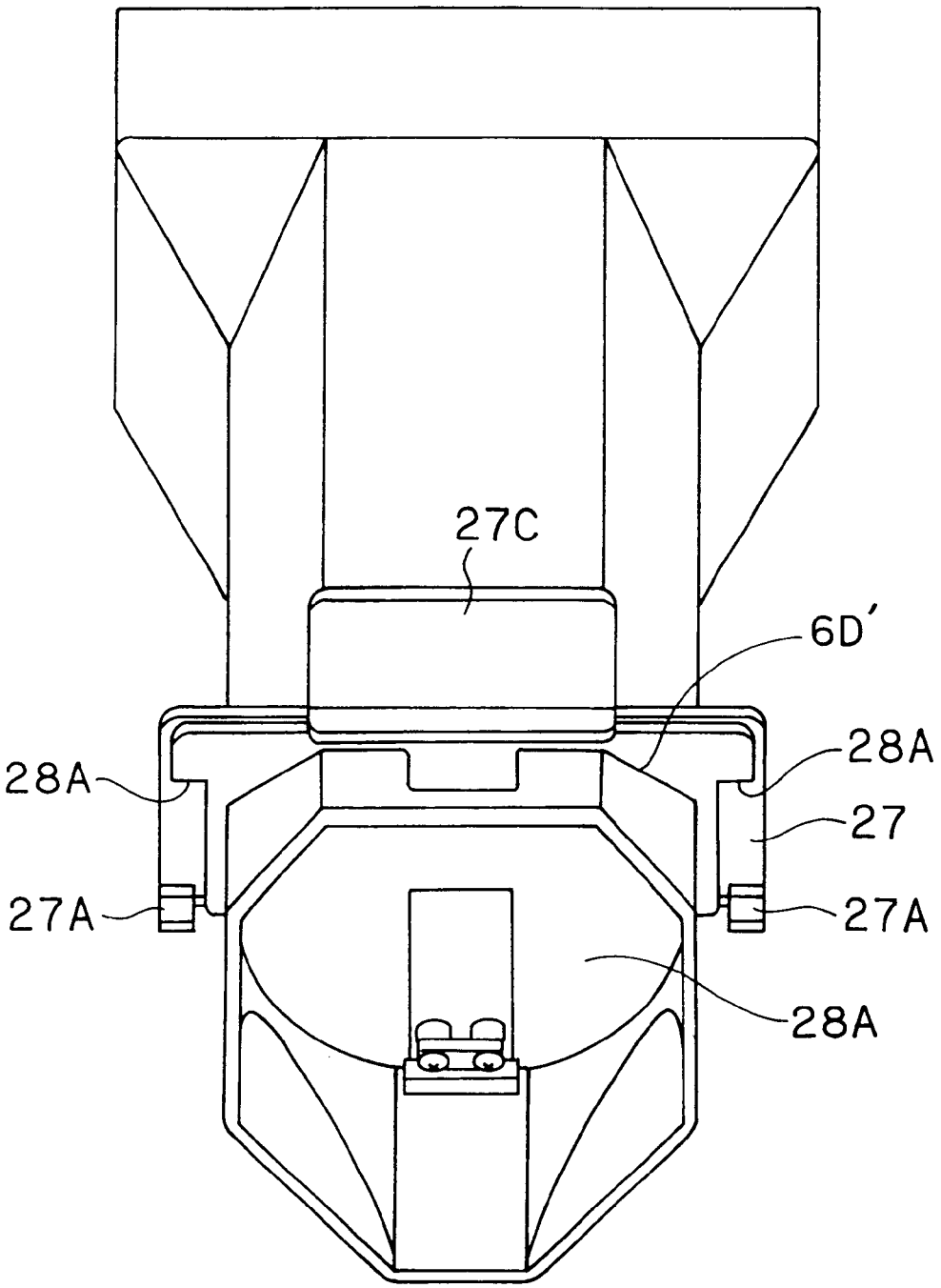
FIG. 7 is a front view showing a chute of the solid drug product supplying apparatus according to the first embodiment of the present invention.

FIG. 6 is a diagram showing two partition plates 27, 28, and FIG. 7 is a diagram showing the chute 6 to which the partition plates 27, 28 are secured.

The two partition plates 27, 28 are slidably fitted in a wide slit 6D' of the chute 6. Accordingly, solid drug products supplied to the chute 6 are dammed by the partition plates 27, 28 and temporarily trapped there. A notch (opening portion) 28B is formed in the partition plate 28 so as to extend upwardly from the lowermost end of the partition plate 28, and the notch 28B is designed so that the solid drug products supplied to the chute 6 can be passed through the notch 28B.

First, the operating manner when a bottle to be filled with solid drug products has a small mouth will be described.

Figures 8A, 8B, 8C:
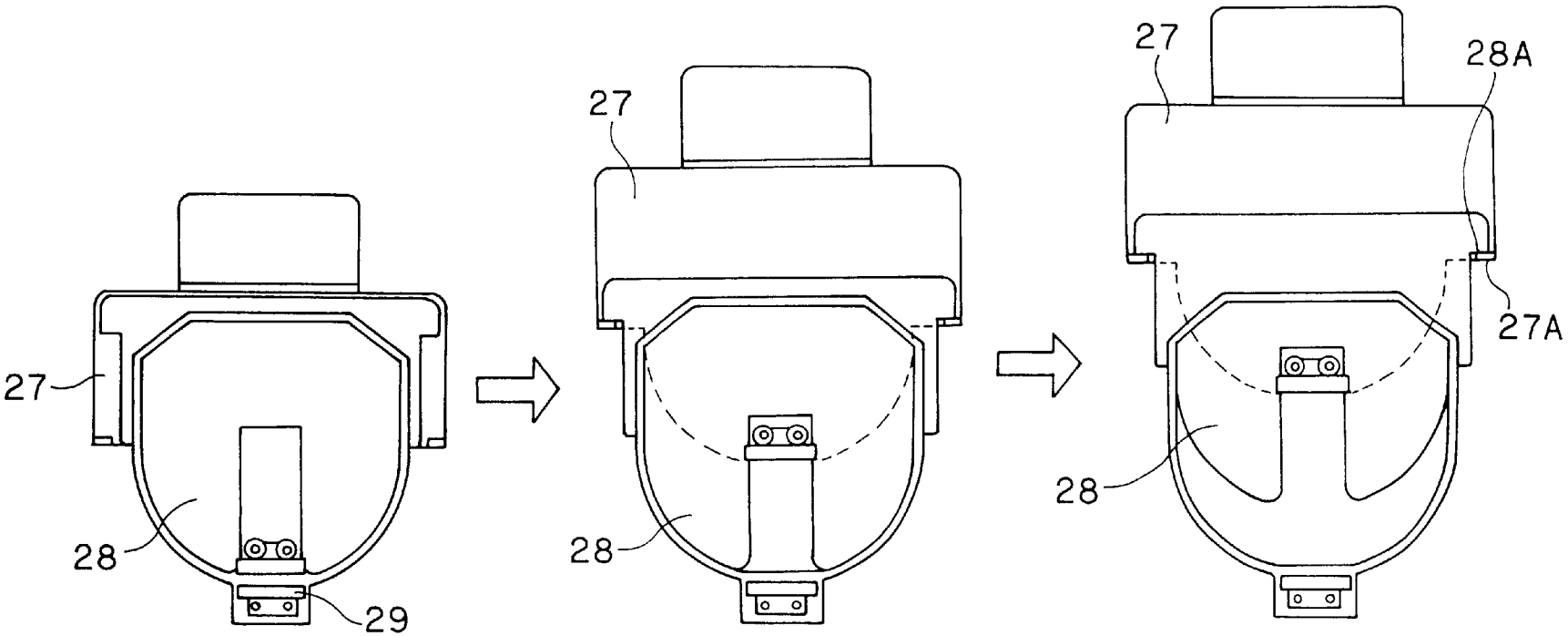
FIGS. 8A to 8C are diagrams showing the operation of the partition plate of the solid drug product supplying apparatus according to the first embodiment of the present invention.

When a pharmacist or the like puts the mouth of the bottle to the outlet of the chute 6 and slides the tab 27C of the first partition plate 27 upwardly, only the first partition plate 27 is slid upwardly while the second partition plate 28 is left unmoved as shown in FIG. 8B. At this time, the notch 28B at the lower end of the second partition plate 28 is opened, and thus the solid drug products pass through the notch 28B and then flow into the bottle.

Accordingly, even when solid drug products are filled into a bottle having a small mouth, the filling work can be excellently performed because the notch 28B is narrow in the lateral direction in spite of the large diameter of the chute 6. If all the solid drug products are filled in the bottle under the above state, the filling work is completed. However, there is a probability that all the solid drug products are not necessarily passed through the notch 28B and thus some drug products are trapped at the partition plate 28.

Therefore, the pharmacist or the like further slides the first partition plate 27 upwardly. At this time, fitting portions 27A formed on the first partition plate 27 abut against fitting portions 28A formed on the second partition plate 28, and thus the second partition plate 28 is slid upwardly interlockingly with the upward slide of the first partition plate 27, whereby the outlet of the lower end of the chute 6 is sufficiently (substantially fully) opened over the overall width thereof as shown in FIG. 8C. Accordingly, all the solid drug products flows into the bottle and the filling work is completed.

Next, the operating manner when a bottle to be filled with solid drug products has a large mouth will be described.

A pharmacist or the like puts the mouth of the bottle to the outlet of the chute 6 and sufficiently slides the first partition plate 27 upwardly to open the outlet of the lower end of the chute 6 as shown in FIG. 8C. Accordingly, the outlet of the lower end of the chute 6 is sufficiently opened and thus all the solid drug products flow into the bottle. Therefore, the filling work is completed.

In FIG. 8, reference numeral 29 represents a sensor comprising a magnet switch for detecting the opening/closing state of the partition plate 27.

Next, a solid drug product supplying apparatus according to a second embodiment of the present invention will be described with reference to FIGS. 1 and 2 and 9 to 11.

The basic construction of the solid drug product supplying apparatus is substantially the same as that of FIGS. 1 and 2 except for the chute, and thus the description of the main body of the solid drug product supplying apparatus is omitted.

A chute 6 of the solid drug product supplying apparatus according to this embodiment will be described with reference to FIGS. 9 to 11.

Figure 9:
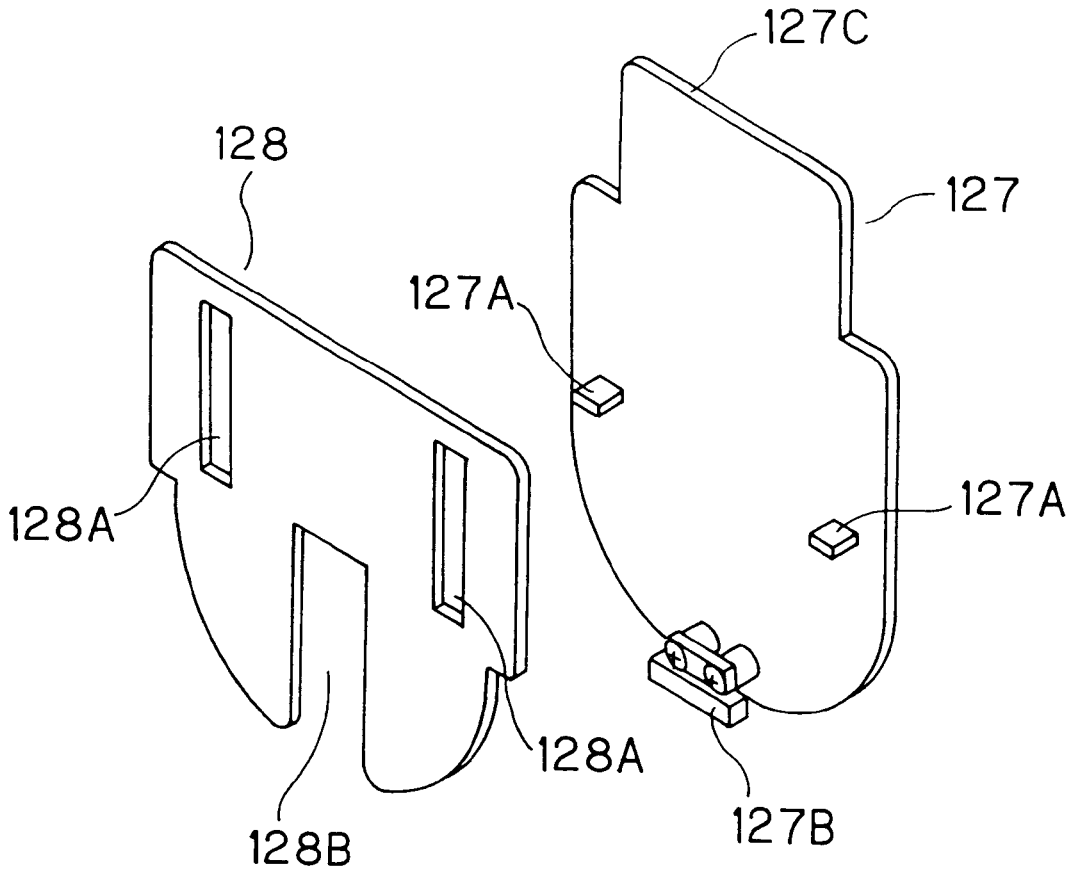
FIG. 9 is a diagram showing a partition plate of a solid drug product supplying apparatus according to a second embodiment of the present invention.
Figure 10:
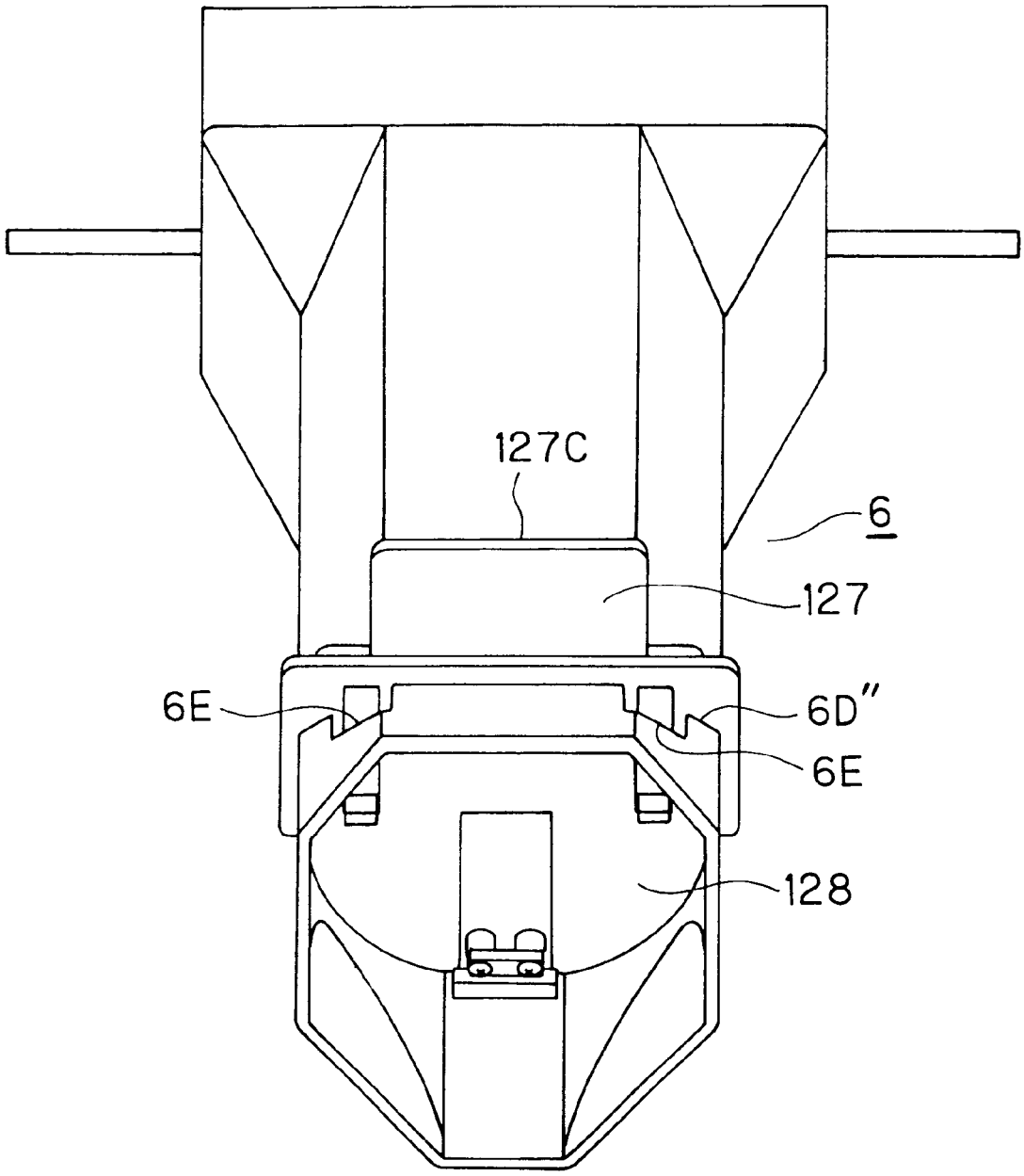
FIG. 10 is a front view showing a chute of the solid drug product supplying apparatus according to the second embodiment of the present invention.

FIG. 9 is a diagram showing two partition plates 127, 128, and FIG. 10 is a diagram showing a chute 6 to which the partition plates 127 and 128 are secured.

The two partition plates 127, 128 are slidably fitted in a wide slit 6D" formed in the chute 6. Reference numeral 6E represents a wider portion formed partially in the slit 6D, and projections 127A provided on the partition plate 127 are allowed to penetrate through the wider portions 6E. The wider portions 6E allow a magnet portion 127B serving as an opening/closing detecting mechanism to pass therethrough when the partition plate 127 is inclined.

Solid drug products supplied to the chute 6 are dammed by the partition plates 127 and 128 and temporarily trapped there.

First, the operating manner when a bottle to be filled with the solid drug products has a small mouth will be described.

Figure 11C:
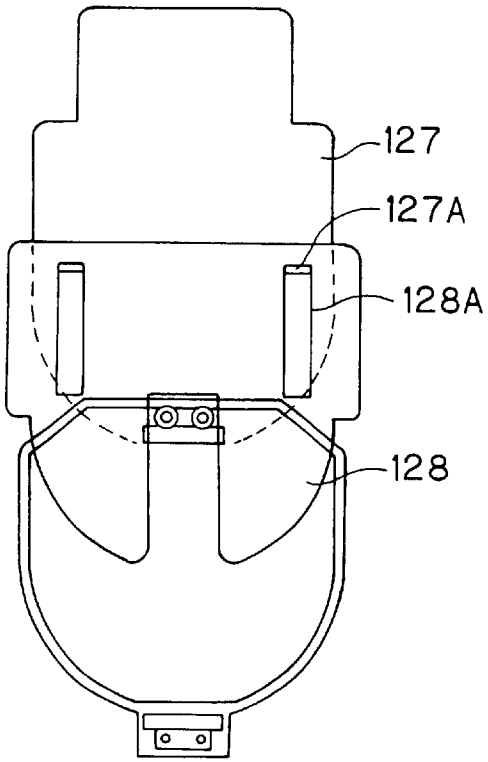
FIGS. 11A to 11C are diagrams showing the operation of the partition plate of the solid drug product supplying apparatus according to the second embodiment of the present invention.
Figure 11B:
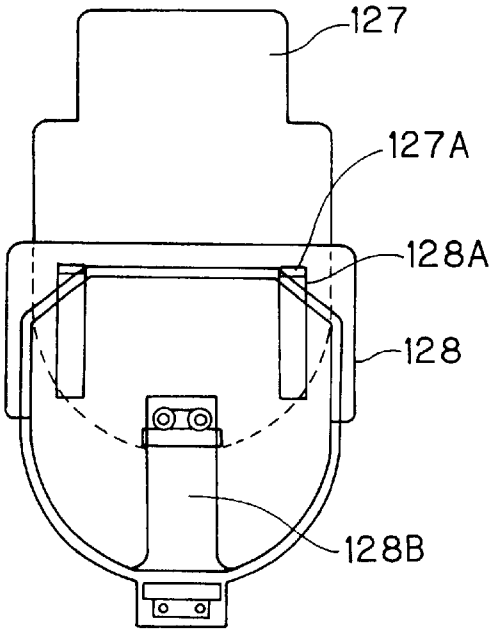
Figure 11A:
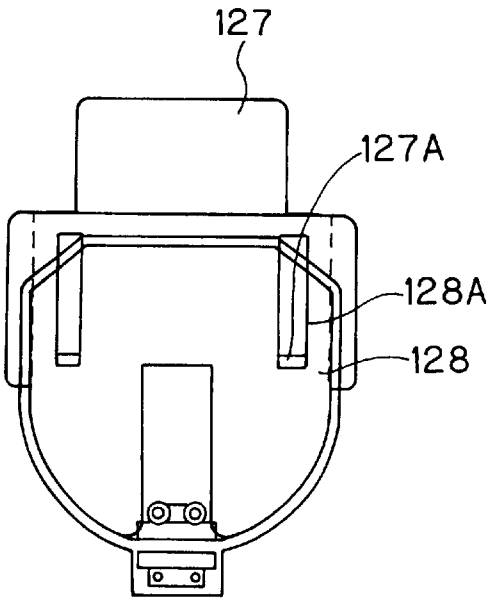

When a pharmacist or the like puts the mouth of the bottle to the outlet of the chute 6 and slides the tab portion 127C of the first partition plate 127 upwardly, only the first partition plate 127 is upwardly slid while the second partition plate 128 is left unmoved as shown from FIG. 11A to FIG. 11B. Accordingly, a notch 128B formed at the lower end of the second partition plate 128 is opened and the solid drug products pass through the notch 128B and flow into the bottle.

As described above, even when a bottle having a small mouth, the filling work can be excellently performed because the notch 128B is narrow in the lateral direction in spite of the large diameter of the chute 6. If all the solid drug products flow into the bottle under the above state, the filling work is completed. However, there is a probability that all the solid drug products are not necessarily passed through the notch 128B and thus some of them are trapped at the second partition plate 128. Therefore, the pharmacist or the like further slides the first partition plate 127 upwardly. At this time, the projections 127A serving as fitting portions of the first partition plate 127 abut against the upper ends of the holes 128A acting as fitting portions of the second partition plate 128, and the second partition plate 128 is also slid upwardly interlockingly with the upward sliding operation of the partition plate 127. Therefore, the outlet of the lower end of the chute 6 is fully opened over the overall width of the outlet. Accordingly, all the solid drug products flow into the bottle and the filling work is completed.

Next, the operating manner when a bottle to be filled with the solid drug products has a large mouth will be described.

A pharmacist or the like puts the mouth of the bottle to the outlet of the chute 6 and sufficiently slides the first partition plate 127 as shown in FIG. 11C to open the outlet of the lower end of the chute 6. Therefore, the outlet of the lower end of the chute 6 is fully opened so that all the solid drug products flow into the bottle, and the filling work is completed.

Figure 12:
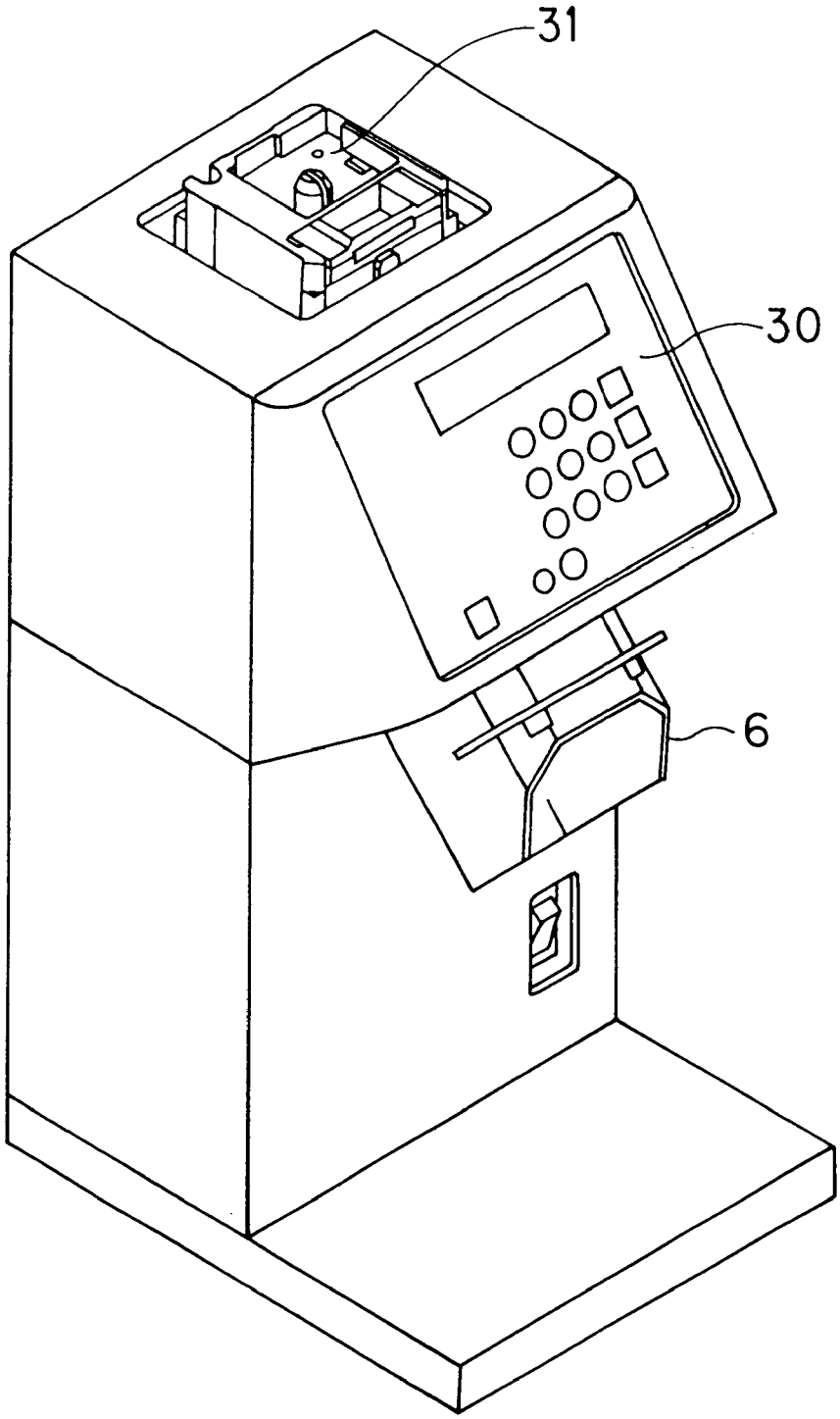
FIG. 12 is a perspective view showing another type solid drug product supplying apparatus.

The chute of each of the first and second embodiments of the present invention are used for a solid drug product supplying apparatus for supplying an indicated kind of solid drug products in plural kinds of solid drug products. However, the present invention is not limited to these embodiments. For example, the present invention may be applied to a solid drug product supplying apparatus for filling solid drug products from a loaded tablet case into a bottle or the like as shown in FIG. 12. In FIG. 12, reference numeral 6 represents a chute, reference numeral 30 represents an operation panel, and reference numeral 31 represents a mount portion into which a table case containing solid drug products is loaded. The mount portion 31 also serves as a driving portion for driving a discharge mechanism in the table case.

The present invention is not limited to the first and second embodiments described above, and various modifications may be made to these embodiments. For example, in the first and second embodiments described above, two partition plates are provided. However, the number of the partition plates is not limited to two, and it may be equal to three or more. In this case, the notch of the last partition plate that starts its sliding operation last is made largest. In this case, the flow amount of the solid drug products trapped in the chute 6 can be stepwise varied in accordance with the sliding amount of the first partition plate (partition plate 27, 127).

Further, in the first and second embodiments described above, the number of the partition plates may be equal to one. In this case, another slit is also formed in the lower wall of the chute 6, and a gradually-enlarging notch (for example, a notch that is gradually enlarged in area in the downward direction) is formed in the partition plate. However, in this case, the overall length of the partition plate is long, and this does not contribute to miniaturization of the apparatus.

In the above embodiments, the open area of the outlet of the chute through which the solid drug products can be passed is increased as the partition plate is upwardly slid. However, it may be modified so that the open area of the outlet of the chute is stepwise or gradually increased as the partition plate is downwardly slid. Further, the sliding direction is not limited to the upper direction, and it may be set to any direction such as a downward direction or lateral direction.

According to the present invention, irrespective of the diameter of the mouth of a container such as a bottle or the like and also irrespective of the shape of solid drug products such as tables or the like, the solid drug products can be stably filled in the container.

What is claimed is:

1. The solid drug product supplying apparatus for supplying solid drug products to a container, characterized by including:

a chute for supplying the solid drug products therethrough to the container; and a partition unit that is slidably secured to said chute to temporarily trap the solid drug products and allows the solid drug products to pass therethrough while the amount of the solid drug products passed is varied in accordance with the sliding amount of said partition unit, wherein said partition unit has an opening portion through which the solid drug products are passed, and the opening portion of said partition unit is varied in area in accordance with the sliding amount of said partition unit.

2. The solid drug product supplying apparatus as claimed in claim 1, wherein the opening portion of said partition unit is increased in area in accordance with the sliding amount of said partition unit.

3. The solid drug product supplying apparatus as claimed in claim 2, wherein the opening portion of said partition unit is stepwise or gradually increased in area in accordance with the sliding amount of said partition unit.

4. The solid drug product supplying apparatus for supplying solid drug products to a container, characterized by including:

a chute for supplying the solid drug products therethrough to the container; and a partition unit that is slidably secured to said chute to temporarily trap the solid drug products and allows the solid drug products to pass therethrough while the amount of the solid drug products passed is varied in accordance with the sliding amount of said partition unit, wherein said partition unit has an opening portion through which the solid drug products are passed, and the lateral width of the opening portion of said partition unit is increased in accordance with the sliding amount of said partition unit.

5. The solid drug product supplying apparatus for supplying solid drug products to a container, characterized by including:

a chute for supplying the solid drug products therethrough to the container; and a partition unit that is slidably secured to said chute to temporarily trap the solid drug products and allows the solid drug products to pass therethrough while the amount of the solid drug products passed is varied in accordance with the sliding amount of said partition unit, wherein both the wall of said partition unit and the inner wall of said chute define an opening portion through which the solid drug products are passed, and the opening portion is varied in area in accordance with the sliding amount of said partition unit.

6. The solid drug product supplying apparatus for supplying solid drug products to a container, characterized by including:

a chute for supplying the solid drug products therethrough to the container; and a partition unit that is slidably secured to said chute to temporarily trap the solid drug products and allows the solid drug products to pass therethrough while the amount of the solid drug products passed is varied in accordance with the sliding amount of said partition unit, wherein said partition unit has a first partition plate having a first fitting portion, and a second partition plate having a second fitting portion which is fitted to said first fitting portion when said partition plate is slid by a predetermined sliding amount and is slid interlockingly with the sliding operation of said first partition plate, and an opening through which the solid drug products are allowed.

7. The solid drug product supplying apparatus as claimed in claim 6, wherein the opening is a notch extending upwardly from the lowermost end of said second partition plate.

8. The solid drug product supplying apparatus for supplying solid drug products to a container, characterized by including:

a chute for supplying the solid drug products therethrough to the container; and a partition unit that is slidably secured to said chute to temporarily trap the solid drug products and allows the solid drug products to pass therethrough while the amount of the solid drug products passed is varied in accordance with the sliding amount of said partition unit, wherein said solid drug product supplying apparatus supplies an indicated kind of solid drug products in plural kinds of solid drug products to said chute.

* * * * *